US005706162A

United States Patent [19]

Bergen et al.

[11] Patent Number: 5,706,162

[45] Date of Patent: Jan. 6, 1998

[54] CORONA GENERATING DEVICE

[75] Inventors: Richard F. Bergen, Ontario; Robert W. Gundlach, Victor, both of N.Y.

[73] Assignee: Xerox Corporation, Stamford, Conn.

[21] Appl. No.: 355,577

[22] Filed: Dec. 14, 1994

[51] Int. Cl.[6] ..... H01T 19/00; G03G 15/02

[52] U.S. Cl. ..... 361/230; 361/229

[58] Field of Search ..... 361/212, 220, 361/221, 225, 230, 235, 213, 214, 229; 250/324–326, 423 F

[56] References Cited

U.S. PATENT DOCUMENTS

| | | | |
|---|---|---|---|
| 2,588,699 | 3/1952 | Carlson | 95/1.9 |
| 2,777,957 | 1/1957 | Walkup | 250/49.5 |
| 2,932,742 | 4/1960 | Ebert | 250/49.5 |
| 4,086,650 | 4/1978 | Davis et al. | 361/229 |
| 4,155,093 | 5/1979 | Fotland et al. | 346/159 |
| 4,425,035 | 1/1984 | Tarumi et al. | 355/3 |
| 4,562,447 | 12/1985 | Tarumi et al. | 346/159 |
| 4,783,716 | 11/1988 | Nagase et al. | 361/225 |
| 4,841,146 | 6/1989 | Gundlach et al. | 250/324 |
| 5,245,502 | 9/1993 | Genovese | 361/255 |
| 5,257,045 | 10/1993 | Bergen et al. . | |
| 5,420,375 | 5/1995 | Folkins et al. | 355/264 |
| 5,448,342 | 9/1995 | Hays et al. | 355/259 |

*Primary Examiner*—Fritz Fleming
*Attorney, Agent, or Firm*—Lloyd F. Bean, II

[57] ABSTRACT

A single piece, planar, integral corona generating device that applies a uniform charge to a charge retentive surface, including a dielectric layer, corona producing element formed on one side of the dielectric layer, reference electrode positioned on the other side of the dielectric layer, for controlling the charge level placed on the charge retentive surface by the corona producing element, for applying a low DC voltage to the reference electrode; and AC high voltage connected to the corona producing element for applying sufficient voltage to the corona producing elements so that ions are emitted from the reference electrode.

23 Claims, 8 Drawing Sheets

CORONA GENERATING DEVICE

Corona charging of xerographic photoreceptors has been disclosed as early as U.S. Pat. No. 2,588,699. It has always been a problem that current levels for practical charging require coronode potentials of many thousands of volts, while photoreceptors typically cannot support more than 1000 volts surface potential without dielectric breakdown.

One attempt at controlling the uniformity and magnitude of corona charging is U.S. Pat. No. 2,777,957 which makes use of an open screen as a control electrode, to establish a reference potential, so that when the receiver surface reaches the screen voltage, the fields no longer drive ions to the receiver, but rather to the screen. Unfortunately, a low porosity screen intercepts most of the ions, allowing a very small percentage to reach the intended receiver. A more open screen, on the other hand, delivers charges to the receiver more efficiently, but compromises the control function of the device.

Other methods exist for trying to obtain uniform charging from negative charging systems such as dicorotron charging devices as shown in U.S. Pat. No. 4,086,650 that include glass coated wires and large specialized AC power supplies. Devices for modulating ions include U.S. Pat. Nos. 4,425,035 and 4,562,447 which disclose an ion modulating electrode for an electrostatic recording apparatus. The ion modulating electrode includes a continuous layer of conductive material and a segmented layer of conductive material separated from each other by an insulating layer. The insulating layer includes a plurality of apertures, which may be bored by a laser beam, through which the ions flow. U.S. Pat. No. 2,932,742 discloses an apparatus for charging a xerographic plate and has a screen electrode consisting of alternating conductive areas having open spaces therebetween. U.S. Pat. No. 4,841,146 is directed to a self cleaning charging unit that includes an insulating housing and a current limited, low capacitance corona wire positioned within the housing and located 0.5–6 mm away from biased conductive plates which form a slit through the bottom of the housing that allows ions to pass therethrough onto a receptor surface. These devices have not been entirely satisfactory since some of these are costly, while others are difficult to fabricate and most are inefficient.

A scorotron charging device that meets some of the above deficiencies is U.S. Pat. No. 4,963,738 which is directed to a charging device having a coronode that includes a comb-like ruthenium glass electrode silk screened onto a supporting dielectric substrate. The teeth of the comb-like electrode extend to an edge of the dielectric substrate and positionable relative to a screen or slit in order to form a scorotron. But, the problem with this unit is that it requires three structures (a corotron generator, insulator and counter electrode) to be carefully aligned in a support frame.

Present slit type scorotrons require precise alignment of at least three parts in a support frame. For example, the charging unit in U.S. Pat. No. 4,963,738 requires exact alignment of the charging elements, the insulator element and the reference electrode. Electrode cooperates with and is positioned adjacent to reference electrode in order to form a slit through which ions are emitted. The device includes a flat scorotron positioned in a horizontal plane above a charge retentive surface supported on a grounded conductor and a high voltage supply is connected to buss bar which in turn, is connected to a comb-like member having coronode lines 14. Electrode and reference electrode are used for potential leveling.

U.S. Pat. No. 5,153,435 discloses a charging device in which the need for precise alignment of parts is eliminated. The rigid, one-piece, slotted scorotron comprises a substrate of a thin planar piece of alumina with a ruthenium comb-like pattern on one side, and a solid conductor on the opposite side. Alumina substrate has machined, staggered slots, e.g., formed by the use of lasers, therein that form a series of slits that allow ion flow. Each slot serves the function of the slit in U.S. Pat. No. 4,963,738, i.e., the terminated ruthenium tips of fingers are the corona source, and the solid metal electrode provides the pumping fringe fields and the reference potential. All of the above-mentioned references are incorporated herein by reference.

Accordingly, a single piece, planar, integral corona generating device that applies a uniform charge to a charge retentive surface, including a dielectric layer, corona producing means formed on one side of said dielectric layer, reference electrode means positioned on the other side of the dielectric layer, for controlling the charge level placed on the charge retentive surface by the corona producing means, means for applying a low DC voltage to the reference electrode means; and AC high voltage means connected to the corona producing means for applying sufficient voltage to the corona producing means that corona ions are driven from the reference electrode means. This planar design has the advantage over prior slit type charging devices in that no alignment of parts is required, no slits need to be cut, no support frame is needed which reduces the size of the scorotron and the robustness of the charger makes it easy to install in a machine and easy to clean.

The foregoing and other features of the instant invention will be more apparent from a further reading of the specifications, claims and from the drawing in which:

For a general understanding of the features of the present invention, reference is had to the drawings. In the drawings, like reference numerals have been used throughout to designate identical elements.

Figure 10:
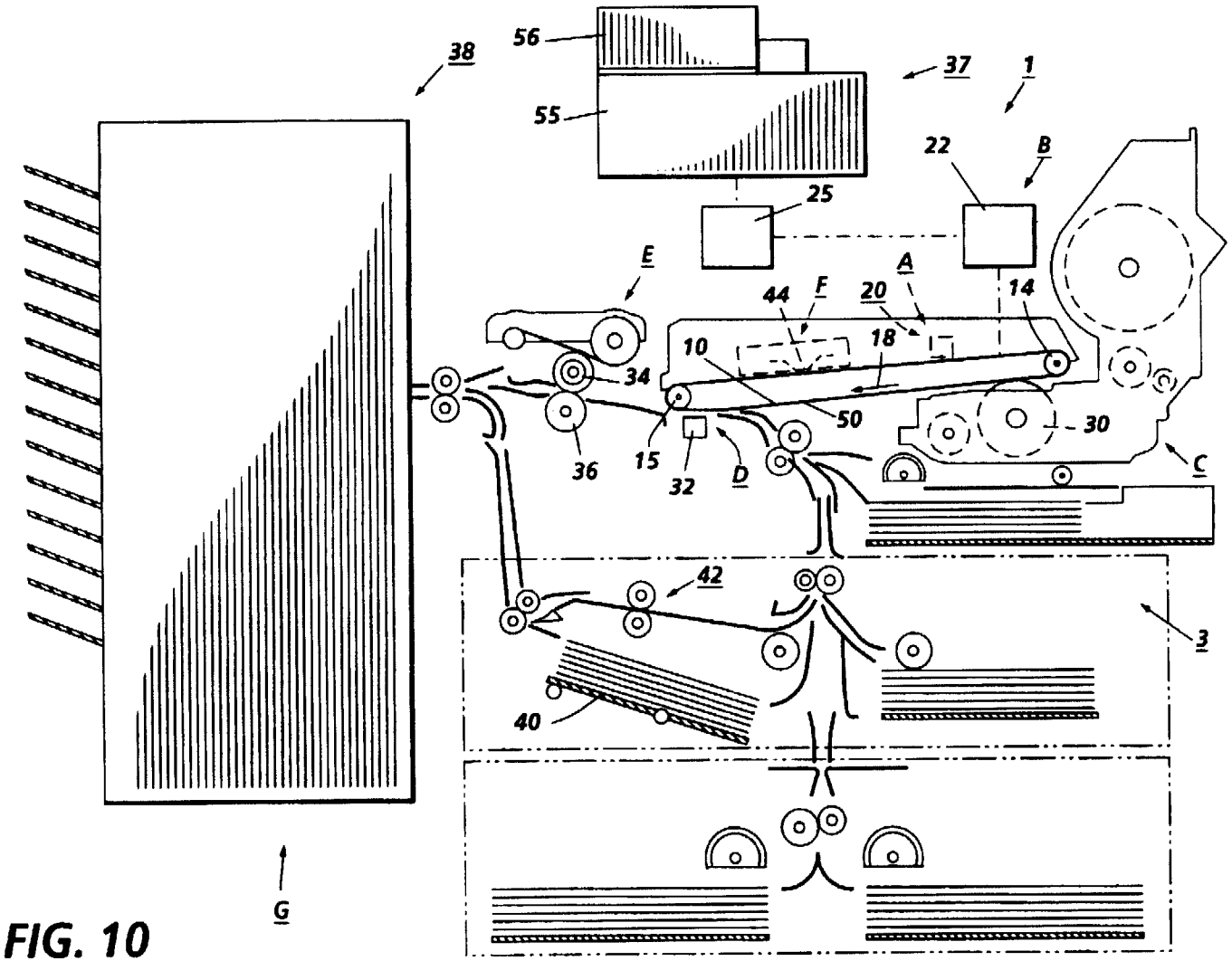
FIG. 10 is a schematic, elevational view depicting an illustrative electrophotographic printing machine incorporating the corona generating device of the present invention.

FIG. 10 schematically depicts an illustrative electrophotographic printing machine, such as disclosed in U.S. Pat. No. 5,258,817 in which the contents of which are incorporated by reference herein. While a specific printing machine is shown and described, the present invention may be used with other types of printing systems. Specifically, the printing machine 1 of FIG. 10 has both a copy sheet transport system 3 for transporting sheets of material such as paper, mylar and the like, to and from processing stations of the machine 1. The machine 1, has conventional imaging processing stations associated therewith, including a charging station A, an imaging/exposing station B, a development station C, a transfer station D, a fusing station E, a cleaning station F and a finishing station G. The machine 1 has a photoconductive belt 10 with a photoconductive layer 50. The belt 10 is entrained about a drive roller 14 and a tension roller 15. The drive roller 14 functions to drive the belt in the direction indicated by arrow 18. The drive roller 14 is itself driven by a motor (not shown) by suitable means, such as a belt drive.

The operation of the machine 1 can be briefly described as follows:

A document is scanned by compact scanner 37 with array. The array provides image signals or pixels representative of the image scanned which after suitable processing by processor 300, are output to light source 22. Processor 300 converts the analog image signals output by the array to digital and processes the image signals as required to enable machine 1 to store and handle the image data in the form required to carry out the job programmed. Processor 300 also provides enhancements and changes to the image signals such as filtering, thresholding, screening, cropping, reduction/enlarging, editing, etc.

The photoconductive belt 10 is charged at the charging station A by a corona generating device 20 of the present invention. The charged portion of the belt is then transported by action of the drive roller 14 to the imaging/exposing station B where a latent image is formed on the belt 10 by light source 22. In this case, it is preferred that the light source is a raster output scanning device (a ROS) which is driven in response to signals from processor 300.

The portion of the belt 10 bearing the latent image is then transported to the development station C where the latent image is developed by electrically charged toner material from a magnetic developer roller 30 of the developer station C. The developed image on the belt is then transported to a transfer station D where the toner image is transferred to a copy sheet substrate transported in the copy sheet transport system 3. In this case, a corona generating device 32 of the present invention is provided to attract the toner image from the photoconductive belt 10 to the copy sheet substrate. The copy sheet substrate with image thereon is then directed to the fuser station E. The fuser at station E includes a heated fuser roll 34 and backup pressure roll 36. The heated fuser roll and pressure roll cooperate to fix the image to the substrate. The copy sheet then, as is well known, may be selectively transported to an output tray (not shown) through a finishing device 38 or along a selectable duplex path including apparatus for buffered duplexing and for immediate duplexing (i.e., tray 40 and path 42 in the case of the illustrative printing machine of FIG. 10). The portion of the belt 10 which bore the developed image is then transported to the cleaning station F where residual toner and charge on the belt is removed in a conventional manner by a blade edge 44 and a discharge lamp (not shown). The cycle is then repeated.

The foregoing description should be sufficient to illustrate the general operation of an electrophotographic printing machine.

Figure 1A:
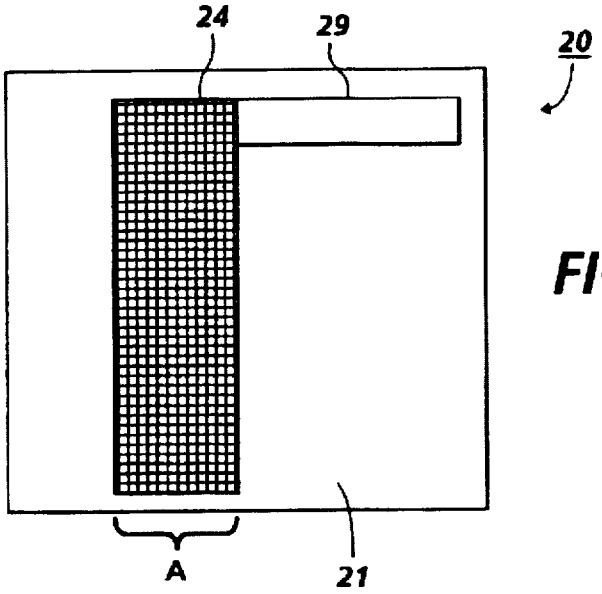
FIGS. 1A–1C are top views of an embodiment of the corona generating device of the present invention.
Figure 1B:
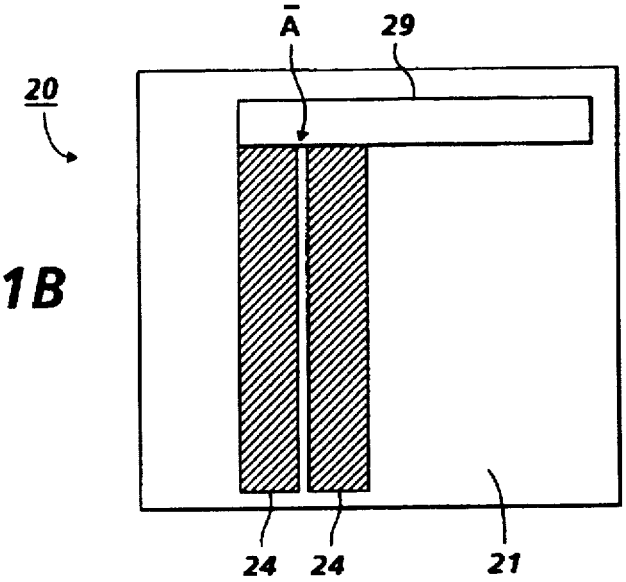
Figure 1C:
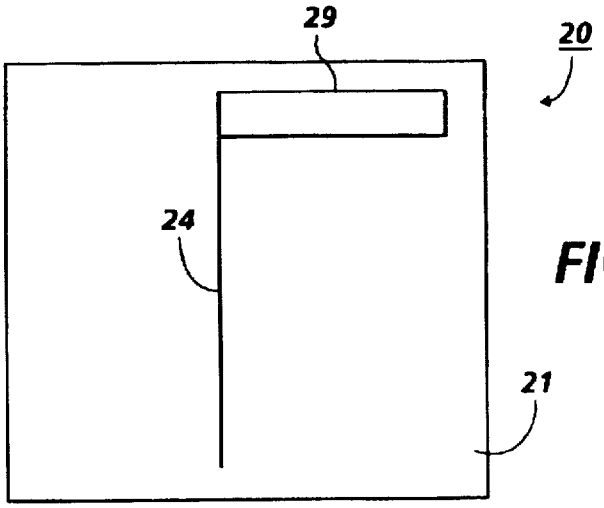
Figure 2:
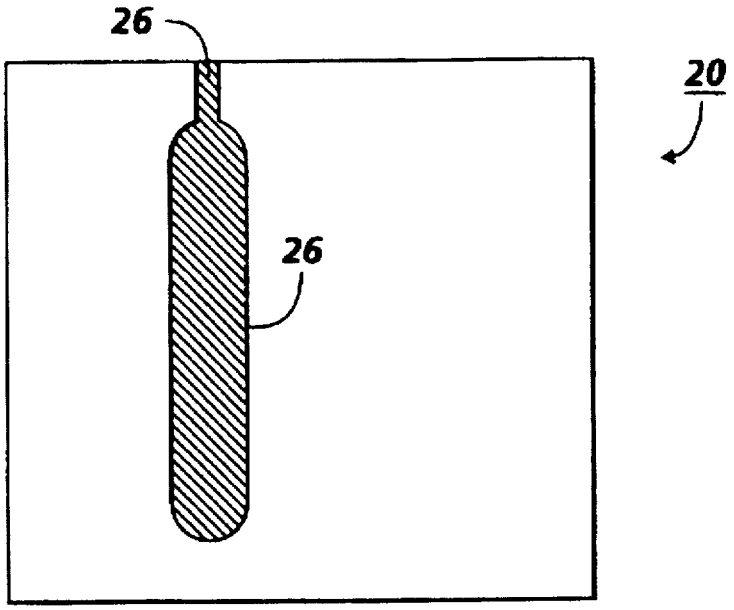
FIG. 2 is a bottom view of the corona generating device of FIG. 1A.
Figure 3A:
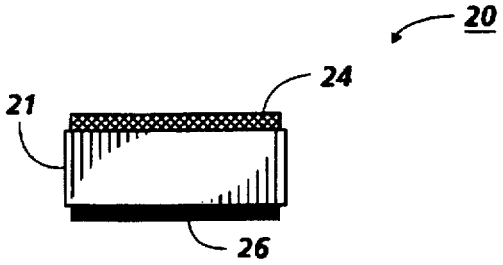
FIG. 3A is a side view of the corona generating device of FIG. 1A.
Figure 3B:
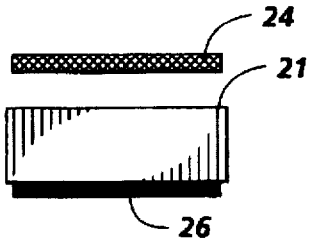
FIG. 3B is a side view of the corona generating device with the upper reference electrode being spaced from the supporting substrate.
Figure 3C:
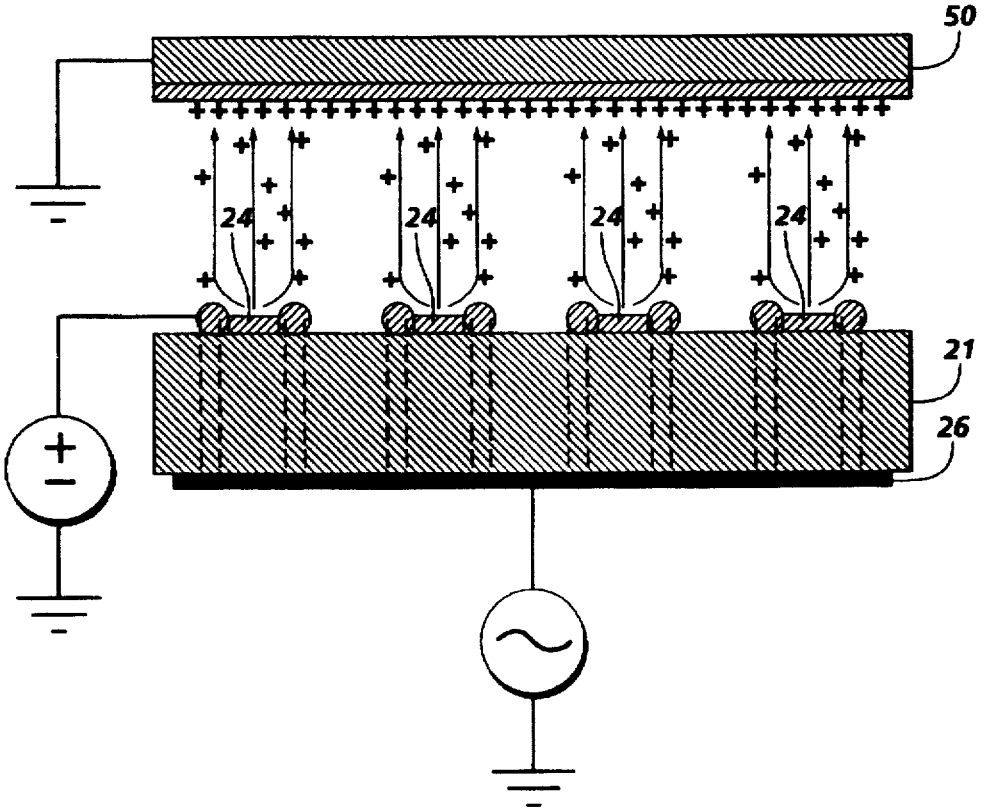
FIG. 3C is an enlarged cross section of the corona generating device of FIG. 1A.

With reference to FIGS. 1–3 planar ion source 20 includes a low DC voltage source 202, e.g. 1000 V, which is electrically connected to an upper electrode(s) 24 (reference electrode). Alternatively, an AC power source (not shown) could be applied to electrode 24 for special application, such as at a detacking station to neutralize charges on the sheet. A high AC voltage, source 200, e.g., 4 kVp-p, which is electrically connected to a lower electrode 26 (corona producing). Both electrode 24 and 26 comprise suitable conductive materials such as copper or palladium silver in a ceramic or glass binder, all of which are supported on the top and bottom surfaces of insulating/dielectric support 21, preferably containing between 50% to 100% of alumina ($Al_2O_3$). Upper electrode 24 has a pattern on the top surface of insulator support 21 for potential leveling purposes and has a low voltage, e.g., 1000 V applied. The pattern can be any desired shape, for example a slit like pattern (as shown in FIG. 1B); a grid-like pattern ( as shown in FIG. 1A) or a line ( as shown in FIG. 1C). For FIGS. 1A and 1B, lower electrode 26 has a conductive solid area with a length and width preferably the same as the upper electrode. FIG. 1B has a thin lower electrode with the size and shape of the slit formed by upper electrodes 24. Insulating support 21 separates the upper and lower electrodes 24 and 26 with its preferable thickness of about 0.5 mm (0.020"), however, the thickness can range from about 0.005 to about 0.100". It is desirable to apply an insulating overcoat on AC powered lower electrode for preventing corona formation on that electrode. In operation of the present invention the AC lower electrode on one side of a substrate provides fields that generate corona within the screen apertures on the upper electrode. DC potential applied to the upper electrode, such as a screen, provides the fields to drive and level charges to the charge retentive surface. Referring to FIG. 3C corona is produced on the edges of the pattern for example for a screen pattern corona is produced in the apertures, at the edges of the screen and the field due to the voltage on the screen, drives the ions to the imaging receptor.

One advantageous feature of the present invention is that the charging and/or transfer characteristic can be selected to meet charging transfer requirements by selecting the appropriate width of the upper and lower electrodes, for example the corona generated and available for charging is linearly related to the width as measured in the process direction, of the charging zone A. A 1 mm wide screen generates 6 times less corona than a 6 mm wide screen.

Yet another advantageous of the present invention is that power supplies or control circuitry for the corona generating device can be incorporated on the same alumina support using conventional surface mount electronic construction techniques.

Figure 4:
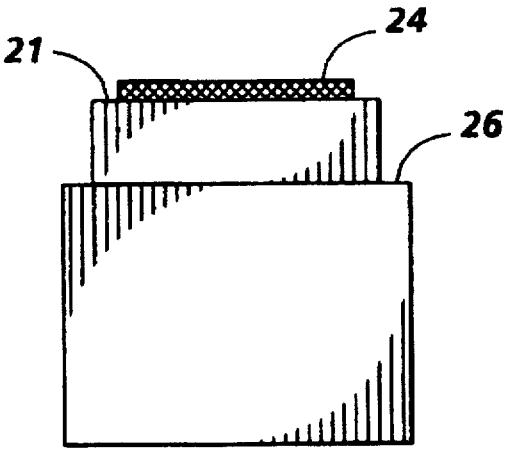
FIG. 4 is a side view of a second embodiment of the corona generating device of the present invention.

In a second embodiment of the present invention, as shown in FIG. 4, lower electrode 26 comprises a relatively thick conductive substrate 26, such as any metal having a plasma sprayed insulating layer 21 of dielectric material, preferably alumina, coated on the top surface with conductive electrode 24. Upper electrode 24 comprises a conductive layer, such as a conductive ink, or palladuim/silver ceramic material; insulating layer 21 has a thickness of about 0.001, however, the thickness can range from about 0.0001" to about 0.100". Conductive substrate 26 thickness range from a fraction of an inch to may inches, and is dependent upon application.

Figure 5A:
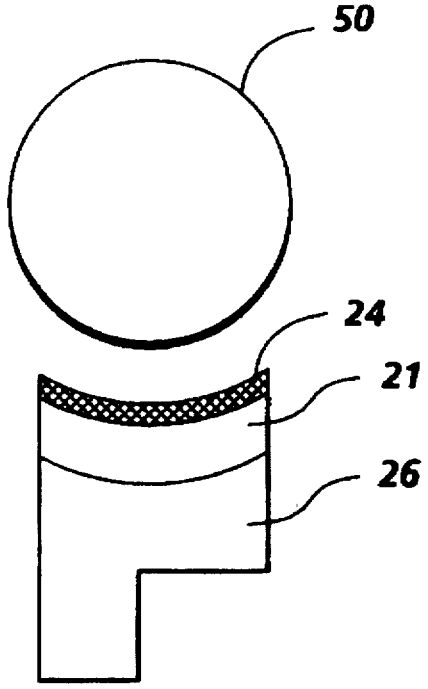
FIG. 5A is a side view of a third embodiment of the corona generating device of the present invention.

An advantage of the second embodiment is that a substrate can be readily fashioned to match the curvature of the receptor, as shown in FIG. 5A, this enables more flexibility in the placement of the charging device and also provides a substrate which is less prone to breaking as compared to prior art ceramic substrate devices. Also, the curvature of the screen matching the curvature of the receptor allows for charging efficiently and uniformly along and around the curved surface.

In a third embodiment of the present invention, as shown in FIG. 3B, lower electrode comprises a lower electrode 26 having an insulating substrate 21 of alumina coated on the top surface is upper electrode 24. Upper electrode 24 is spaced from insulating substrate 21. Upper electrode 24 comprises a rigid conductive screen 40. Preferably, upper electrode 24 is spaced about 10 mils from insulating substrate 21 and about 20 mils from the charge receptor however, the spacing from the insulating substrate can range from about 0.1 mm to about 2 mm and the spacing from the charge receptor can range from about 0.1 mm to about 5 mm.

Figure 5B:
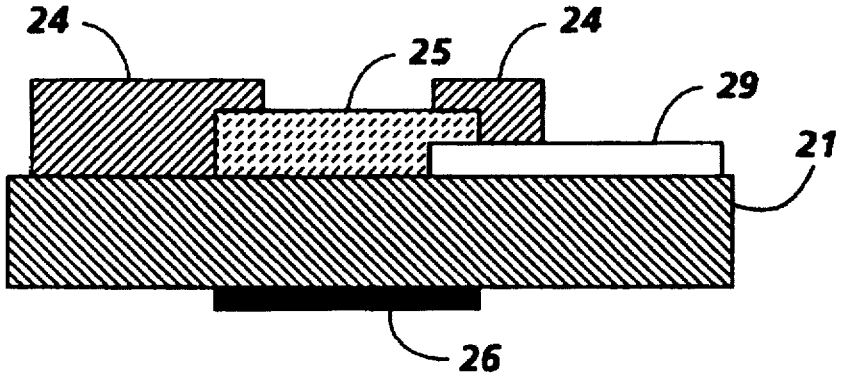
FIG. 5B is a side view of a fourth embodiment of the corona generating device of the present invention.

In a fourth embodiment of the present invention, as shown in FIG. 5B, is of similar structure as the first embodiment of the present invention but includes a resistive layer 25 having a resistance between $10^{-12}$ ohms to $10^{5}$ ohms. A suitable material for the resistive layer is Ruthenium. Conductive electrodes 24 partially cover resistive (semi-conductor) layer 25. Conductor 29 provides the DC voltage to the resistive element 25. Lower electrode 26 is centered relative to the open region between upper electrodes 24. With high voltage and high frequency AC applied to lower electrodes 26, fields extend through insulating layer 21 and resistive material 25 to the edges of the upper conductive electrodes, producing corona at upper electrodes 24 edges. With an AC frequency greater than the response time of the resistive layer, the resistive layer acts as an insulating layer to the AC voltage, and a conductor for the DC voltage. With the resistive layer having DC voltage applied, fields are produced that reach to the charge receptor, with field lines that pass through the corona, since charges follow field lines, they are driven to the receptor, and an efficient charging device results.

Figure 9:
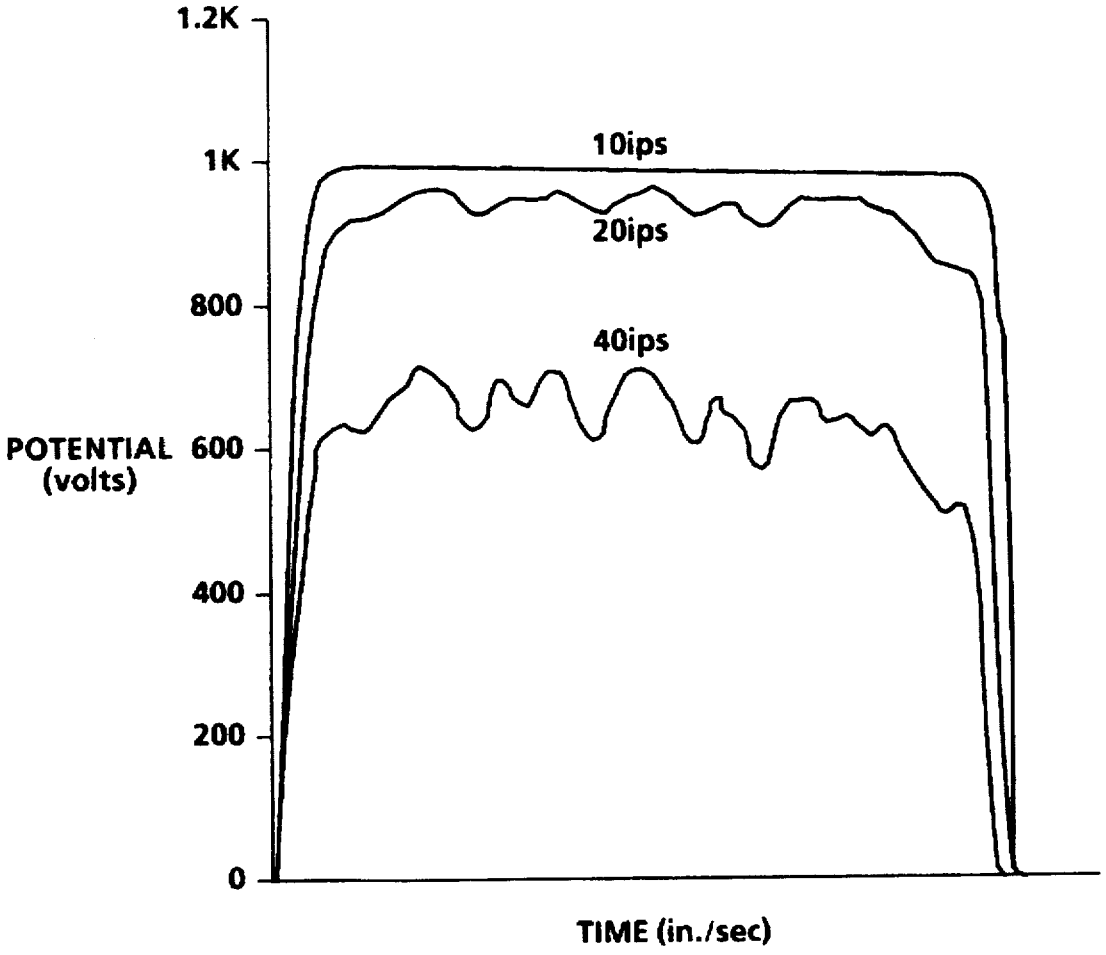
FIG. 9 is experimental data of a charging device in accordance of the present invention.

In operation the present invention for optimum performance, the present invention is placed in propinquity in relation to the charge receptor between from about 0.005" to about 0.25" from the charge receptor. Another advantageous of the present invention is that it offers improved surface charge uniformity as compared to prior art devices. A charging device in accordance of the present invention was tested to charge a 1 rail thick mylar imaging member with a spacing of 20 mils between the charging device and the imaging member. The device had an upper electrode which was a screen pattern with a percent open of 25% composed of 1 mil thick copper in a ceramic binder; lower electrode was composed of 1 mil thick copper in a ceramic binder. The support substrate was a 10 mil thick alumina plate. A 1000 volts D.C. potential was applied to the upper electrode with 3.9 I<Vp-p, @ 50 KHz, applied to the lower electrode. Referring to FIG. 9. It was found that at 10 inches per sec (ips) that the mylar charges up to 1000 volts in a very uniform manner and also the charging device had useful charging characteristic @ 20 ips and 40 ips.

It may be desirable to employ a spacer with the present invention to facilitate maintaining of tolerances between the charging device and the charge receptor. By incorporating a "slippery", non-abrasive spacer on the charging device surface in a charging station, and mounting it to ride against a charge receptor surface, so as to compensate for drum runout and maintain uniformity in charging. Spacers contacting a receptor would not generally be useful, since they would wear with usage effecting charging levels. They could also detrimentally tribo charge the receptor as well. However, an advantageous feature of the present invention is that AC corona provides the charging current to overcome any tribo-charging and to charge the receptor to the screen potential. As wear occurs, the gap diminishes, by the nature of a scorotron, the receptor still charges to the screen potential; it simply reaches the charging asymptote in a shorter time. The spacer thickness required is that of the largest gap where the receptor will charge to the asymptote. The spacer(s) contacting the surface across the process direction may be periodic bumps, or a continuous slab. Either the charging device or the spacer will need to be flexible enough to insure that the spacer makes contact with charge receptor.

Figure 7:
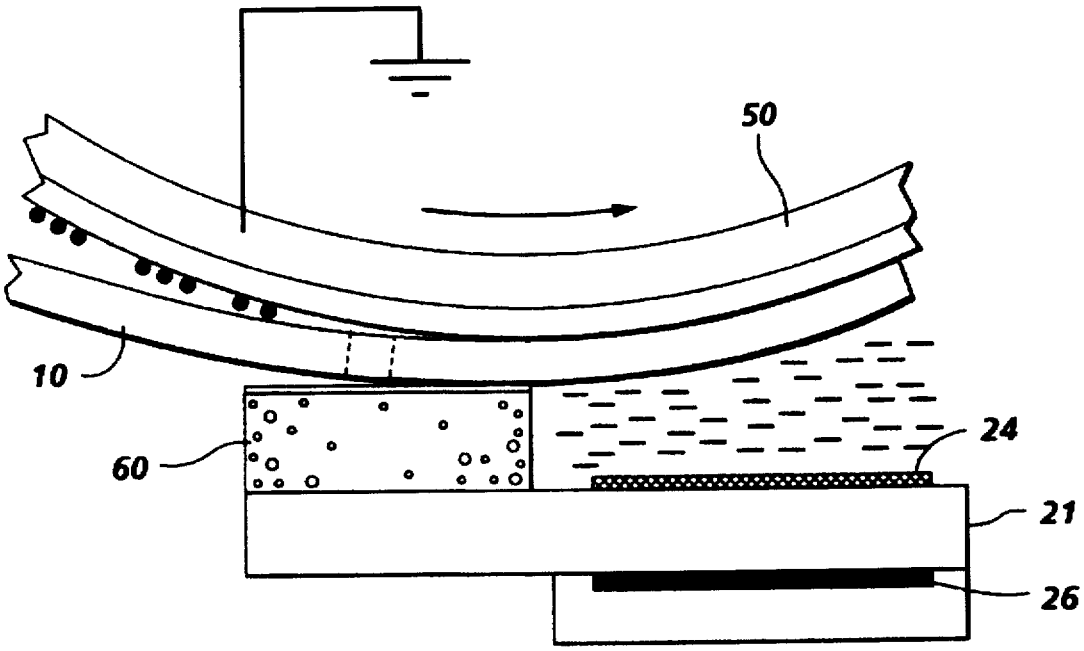
FIG. 7 is a plan view of an embodiment of the corona generating device of the present invention employing a spacer.

Also, a spacer can be useful in a transfer station to reduce transfer deletions, as shown in FIG. 7. By incorporating a spacer onto the unit face in a transfer station, pressure can be applied to copy material 10 nearly simultaneously with the transfer current. A light spring pressure can be applied to the back side of the charging device which forces a tent in the paper to flatten out at the spacer/copy/charge acceptor location. The corona at and near the pressure point exit, simultaneously provides the transfer current before restoring forces of the "tent", occur. There is sufficient gap latitude (from 30 to 40 mils) such that as wear occurs to spacer 60, current delivered should change only slightly. Charge delivery can be adjusted for severe wear as well as copy material e.g. perforated paper, or 20# paper, or transparency stock, by screen voltage changes. The spacers contacting the surface across the process direction may be varied depending on system requirements, e.g. a solid bar, square, round or saw teeth periodic or special patterns. Many singular materials or laminates may be employed for the spacer, and various shapes to electrodes on copy and corona side are possible.

Figure 6:
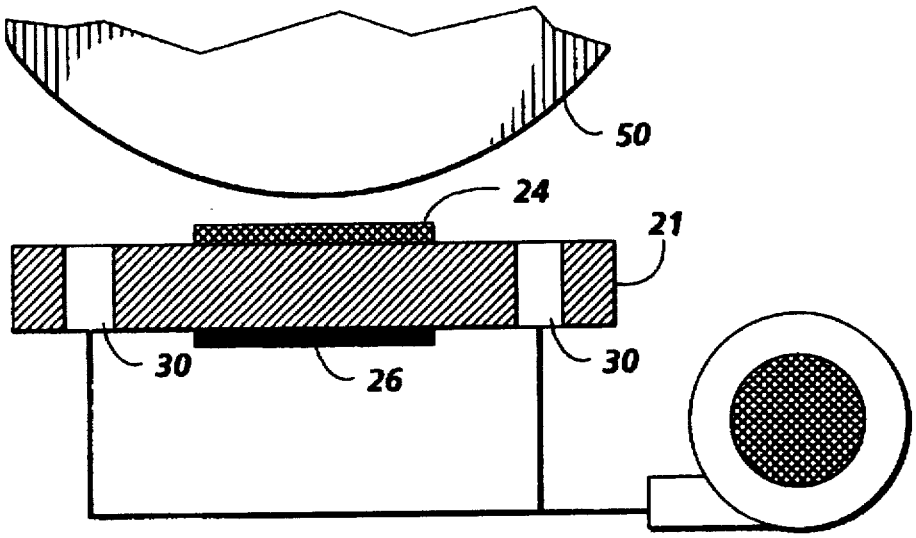
FIG. 6 is a plan view of alternate embodiments of the corona generating device of the present invention showing multiple slots, for an air management system.

It may also be desirable to cut a slot(s) alongside the screen of the present invention, as shown in FIG. 6. A single slot or multiple slots may be employed with associated hardware, for an air management system for the screen and nearby regions. Air flowing in and out of the slots removes unwanted particles (toner), and gases (ozone). In a transfer station employing negative airflow, paper lint could be collected and removed to a filter. So, where ever the present invention is stationed, it offers a remedy for machine problem items such as airborne toner, ozone, and paper lint.

Figure 8:
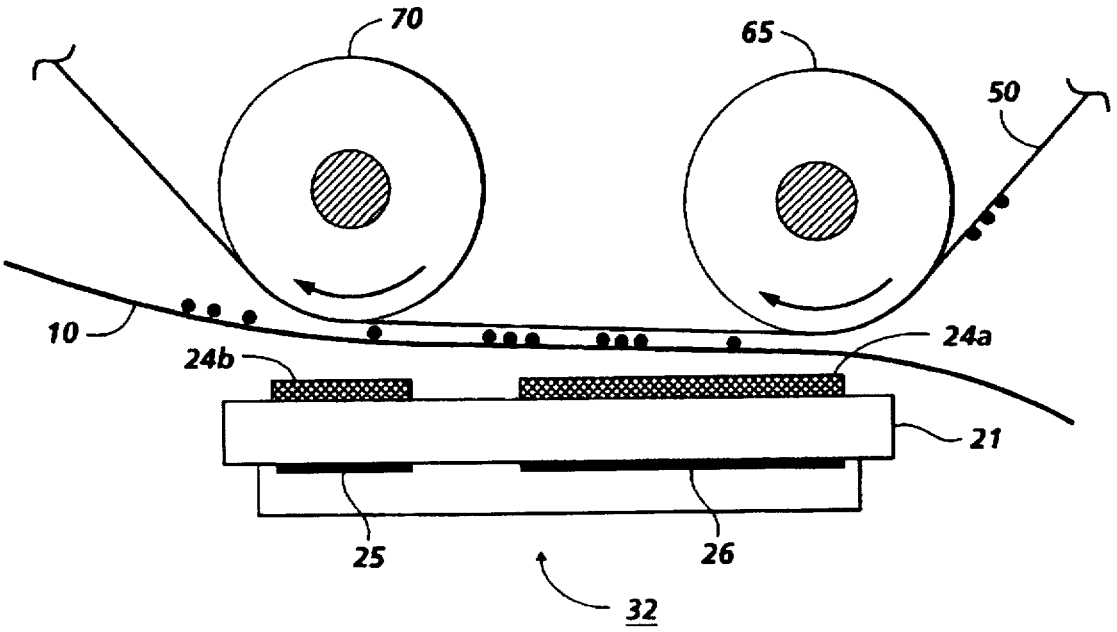
FIGS. 8 is a plan view of alternate embodiments of the scorotron charging device of the present invention showing two corona generating devices integrated on the same substrate.

Referring to FIG. 8, an alternate embodiment of the present invention shows two corona generating devices integrated on the same substrate. There is shown a transfer and detack station. At transfer station 65 upper electrode **24*a* is biased to attract toner off receptor 50 to copy material 10. At detack station 70, upper electrode 24*b* is biased to allow detacking copy material 10 with toner thereon to detack from receptor 50**.

While this invention has been described with reference to the structure disclosed herein, they are not confined to the details set forth and are intended to cover modifications and changes that may come within the spirit of the invention and scope of the claims.

What is claimed is:

1. A corona generating device, comprising:

a dielectric layer;

a corona producing element formed on a surface of said dielectric layer;

a reference electrode, positioned on a surface of said dielectric layer, opposed from the surface having said corona producing element formed thereon for controlling charging by said corona producing element;

a resistive layer interposed between said reference electrode and said dielectric layer;

a voltage source coupled to said reference electrode; and an AC voltage source coupled to said corona producing element for energizing said reference electrode to emit ions therefrom.

2. The corona generating device of claim 1, wherein said dielectric layer comprises a dielectric support substrate for supporting said corona producing element.

3. The corona generating device of claim 2, wherein said corona producing element comprises a conductive layer deposited on said dielectric support substrate.

4. The corona generating device of claim 3, wherein said resistive layer comprises a layer of ruthenium oxide in a glass or ceramic binder.

5. The corona generating device of claim 2, wherein said support substrate is made of alumina.

6. The corona generating device of claim 1, wherein said corona producing element comprises a conductive substrate for supporting said dielectric layer.

7. The corona generating device of claim 6, wherein said dielectric layer has a thickness ranging from about 0.005 to about 0.100 inches with the thickness preferably being about 0.020 inches.

8. The corona generating device of claim 1, further comprising an insulating layer formed on said corona producing element.

9. The corona generating device of claim 1, wherein said reference electrode comprises a pattern defining a slit therein.

10. The corona generating device of claim 1, wherein said reference electrode comprises a pattern defining a plurality of apertures therein.

11. The corona generating device of claim 1, further comprising said insulative spacer disposed on a surface of said reference electrode.

12. The corona generating device of claim 1, wherein said resistive layer has a resistance between $10^{-12}$ ohms to $10^{5}$ ohms.

13. A printing apparatus using a generating device, comprising:

a dielectric layer;

a corona producing element formed on a surface of said dielectric layer;

a reference electrode, positioned on a surface of said dielectric layer, opposed from the surface having said corona producing element formed thereon for controlling charging by said corona producing element;

a resistive layer interposed between said reference electrode and said dielectric layer;

a voltage source coupled to said reference electrode; and an AC voltage source coupled to said corona producing element for energizing said reference electrode to emit ions therefrom.

14. The corona generating device of claim 13, wherein said dielectric layer comprises a dielectric support substrate for supporting said corona producing element.

15. The corona generating device of claim 14, wherein said corona producing element comprises a conductive layer deposited on said dielectric support substrate.

16. The corona generating device of claim 15, wherein said resistive layer comprises a layer of ruthenium oxide in a glass or ceramic binder.

17. The corona generating device of claim 14, wherein said support substrate comprises alumina.

18. The corona generating device of claim 13, wherein said corona producing element comprises a conductive substrate for supporting said dielectric layer.

19. The corona generating device of claim 18, wherein said dielectric layer has a thickness ranging from about 0.005 to about 0.100 inches with the thickness preferably being about 0.020 inches.

20. The corona generating device of claim 13, wherein said reference electrode comprises a pattern defining a slit therein.

21. The corona generating device of claim 13, wherein said reference electrode comprises a pattern defining a plurality of apertures therein.

22. The corona generating device of claim 13, further comprising said insulative spacer disposed on a surface of said reference electrode.

23. The corona generating device of claim 14, wherein said resistive layer has a resistance between $10^{-12}$ ohms to $10^{5}$ ohms.

* * * * *